US008424324B2

(12) United States Patent
Petrenko et al.

(10) Patent No.: US 8,424,324 B2
(45) Date of Patent: Apr. 23, 2013

(54) REFRIGERANT EVAPORATORS WITH PULSE-ELECTROTHERMAL DEFROSTING

(75) Inventors: Victor F. Petrenko, Lebanon, NH (US); Fedor F. Petrenko, Lebanon, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 838 days.

(21) Appl. No.: 12/613,299

(22) Filed: Nov. 5, 2009

(65) Prior Publication Data

US 2010/0107667 A1 May 6, 2010

Related U.S. Application Data

(60) Provisional application No. 61/111,581, filed on Nov. 5, 2008.

(51) Int. Cl.
*F25D 21/06* (2006.01)
*F25B 39/02* (2006.01)

(52) U.S. Cl.
USPC ..... 62/151; 62/154; 62/276; 62/504

(58) Field of Classification Search ..... 62/151, 62/154, 276, 504
See application file for complete search history.

(56) References Cited

U.S. PATENT DOCUMENTS

| | | | |
|---|---|---|---|
| 1,157,344 | A | 10/1915 | Thomson |
| 1,656,329 | A | 1/1928 | Sievert |
| 2,024,612 | A | 11/1933 | Sulzberger |
| 2,205,543 | A | 6/1940 | Rideau et al. |
| 2,496,279 | A | 2/1950 | Ely |
| 2,870,311 | A | 1/1959 | Greenfield |
| 2,988,899 | A | 6/1961 | Heron |
| 3,204,084 | A | 8/1965 | Spencer |
| 3,256,920 | A | 6/1966 | Byers |
| 3,316,344 | A | 4/1967 | Kidd |
| 3,316,345 | A | 4/1967 | Toms |
| 3,380,261 | A | 4/1968 | Hendrix et al. |
| 2,522,199 | A | 10/1969 | Shreve |

(Continued)

FOREIGN PATENT DOCUMENTS

| | | |
|---|---|---|
| BE | 410547 | 7/1935 |
| BE | 528926 | 6/1954 |

(Continued)

OTHER PUBLICATIONS

International Search Report and Written Opinion issued in related PCT Patent Application PCT/US2009/063407, dated May 14, 2010, 12 pages.

(Continued)

*Primary Examiner* — Marc Norman
(74) *Attorney, Agent, or Firm* — Lathrop & Gage LLP

(57) ABSTRACT

An pulse electro thermal defrost evaporator system has multiple refrigerant tubes formed from an electrically conductive metal and connected in parallel for refrigerant flow. These tubes are, however, connected electrically in series. A controller is capable of detecting ice accumulation and connecting the tubes to a source of electrical power for deicing when it is necessary to deice the tubes. Embodiments having a manifold having multiple conductive sections insulated from each other are disclosed for coupling tubes electrically in series. Alternative embodiments with a single, long, wide-bore, tube are disclosed, as are embodiments having an evaporating pan coupled in series or parallel with the tubes, and embodiments with thermal cutoff and electrical safety interlocks.

14 Claims, 9 Drawing Sheets

U.S. PATENT DOCUMENTS

| | | | |
|---|---|---|---|
| 3,790,752 | A | 2/1974 | Boaz |
| 3,809,341 | A | 5/1974 | Levin |
| 3,825,371 | A | 7/1974 | Roder |
| 3,835,269 | A | 9/1974 | Levin |
| 3,915,883 | A | 10/1975 | VanMeter |
| 3,964,183 | A | 6/1976 | Mouat |
| 3,971,056 | A | 7/1976 | Jaskolski |
| 4,081,914 | A | 4/1978 | Rautenbach |
| 4,082,962 | A | 4/1978 | Burgsdorf |
| 4,085,338 | A | 4/1978 | Genrkh |
| 4,119,866 | A | 10/1978 | Genrkh |
| 4,135,221 | A | 1/1979 | Genrkh |
| 4,137,447 | A | 1/1979 | Boaz |
| 4,190,137 | A | 2/1980 | Shimada |
| 4,278,875 | A | 7/1981 | Bain |
| 4,321,296 | A | 3/1982 | Rougier |
| 4,330,703 | A | 5/1982 | Horsma |
| 4,442,681 | A | 4/1984 | Fischer |
| 4,531,380 | A | 7/1985 | Hagen |
| 4,571,860 | A | 2/1986 | Long |
| 4,638,960 | A | 1/1987 | Straube |
| 4,690,353 | A | 9/1987 | Haslim |
| 4,732,351 | A | 3/1988 | Bird |
| 4,737,618 | A | 4/1988 | Barbier |
| 4,760,978 | A | 8/1988 | Schuyler |
| 4,764,193 | A | 8/1988 | Clawson |
| 4,773,976 | A | 9/1988 | Vexler |
| 4,798,058 | A | 1/1989 | Gregory |
| 4,814,546 | A | 3/1989 | Whitney |
| 4,820,902 | A | 4/1989 | Gillery |
| 4,862,055 | A | 8/1989 | Maruyama |
| 4,875,644 | A | 10/1989 | Adams |
| 4,887,041 | A | 12/1989 | Mashikian |
| 4,897,597 | A | 1/1990 | Whitener |
| 4,950,950 | A | 8/1990 | Perry |
| 4,985,313 | A | 1/1991 | Penneck |
| 5,057,763 | A | 10/1991 | Torii et al. |
| 5,109,140 | A | 4/1992 | Nguyen |
| 5,112,449 | A | 5/1992 | Jozefowicz |
| 5,143,325 | A | 9/1992 | Zieve |
| 5,144,962 | A | 9/1992 | Counts |
| 5,218,472 | A | 6/1993 | Jozefowicz |
| 5,344,696 | A | 9/1994 | Hastings |
| 5,398,547 | A | 3/1995 | Gerardi |
| 5,408,844 | A | 4/1995 | Stokes |
| 5,411,121 | A | 5/1995 | LaForte |
| 5,441,305 | A | 8/1995 | Tabar |
| 5,496,989 | A | 3/1996 | Bradford |
| 5,523,959 | A | 6/1996 | Seegmiller |
| 5,551,288 | A | 9/1996 | Geraldi |
| 5,582,754 | A | 12/1996 | Smith |
| 5,605,418 | A | 2/1997 | Watanabe |
| 5,744,704 | A | 4/1998 | Hu |
| 5,861,855 | A | 1/1999 | Arsenault |
| 5,873,254 | A | 2/1999 | Arav |
| 5,886,321 | A | 3/1999 | Pinchock |
| 5,902,962 | A | 5/1999 | Gazdzinski |
| 5,934,617 | A | 8/1999 | Rutherford et al. |
| 5,947,418 | A | 9/1999 | Bessierre |
| 6,018,152 | A | 1/2000 | Allaire |
| 6,027,075 | A | 2/2000 | Petrenko |
| 6,031,214 | A | 2/2000 | Bost |
| 6,129,314 | A | 10/2000 | Giamati |
| 6,133,555 | A | 10/2000 | Brenn |
| 6,145,787 | A | 11/2000 | Rolls |
| 6,193,793 | B1 | 2/2001 | Long et al. |
| 6,194,685 | B1 | 2/2001 | Rutherford |
| 6,227,492 | B1 | 5/2001 | Schellhase |
| 6,237,874 | B1 | 5/2001 | Rutherford et al. |
| 6,239,601 | B1 | 5/2001 | Weinstein |
| 6,246,831 | B1 | 6/2001 | Seitz et al. |
| 6,266,969 | B1 | 7/2001 | Malnati et al. |
| 6,270,118 | B1 | 8/2001 | Ichikawa |
| 6,279,856 | B1 | 8/2001 | Rutherford |
| 6,294,765 | B1 | 9/2001 | Brenn |
| 6,297,165 | B1 | 10/2001 | Okumura |
| 6,297,474 | B1 | 10/2001 | Kelly |
| 6,330,986 | B1 | 12/2001 | Rutherford |
| 6,396,172 | B1 | 5/2002 | Couture |
| 6,427,946 | B1 | 8/2002 | Petrenko |
| 6,492,629 | B1 | 12/2002 | Sopory |
| 6,558,947 | B1 | 5/2003 | Lund |
| 6,653,598 | B2 | 11/2003 | Petrenko |
| 6,693,786 | B2 | 2/2004 | Petrenko |
| 6,723,971 | B1 | 4/2004 | Petrenko |
| 6,825,444 | B1 | 11/2004 | Tuan |
| 6,870,139 | B2 | 3/2005 | Petrenko |
| 7,034,257 | B2 | 4/2006 | Petrenko |
| 2001/0052731 | A1 | 12/2001 | Petrenko |
| 2002/0017466 | A1 | 2/2002 | Petrenko |
| 2002/0092849 | A1 | 7/2002 | Petrenko |
| 2002/0096515 | A1 | 7/2002 | Petrenko |
| 2002/0118550 | A1 | 8/2002 | Petrenko |
| 2002/0170909 | A1 | 11/2002 | Petrenko |
| 2002/0175152 | A1 | 11/2002 | Petrenko |
| 2003/0024726 | A1 | 2/2003 | Petrenko |
| 2003/0046942 | A1 | 3/2003 | Shedivy |
| 2003/0155467 | A1 | 8/2003 | Petrenko |
| 2003/0155740 | A1 | 8/2003 | Lammer |
| 2004/0149734 | A1 | 8/2004 | Petrenko et al. |
| 2006/0086715 | A1 | 4/2006 | Briggs |
| 2006/0272340 | A1* | 12/2006 | Petrenko ..... 62/73 |
| 2007/0045282 | A1 | 3/2007 | Petrenko |
| 2007/0101753 | A1* | 5/2007 | Broadbent ..... 62/349 |

FOREIGN PATENT DOCUMENTS

| | | | |
|---|---|---|---|
| DE | 1476989 | | 10/1969 |
| DE | 2510660 | A1 | 9/1976 |
| DE | 2510755 | | 9/1976 |
| DE | 3626613 | | 2/1988 |
| DE | 3921900 | C1 | 7/1990 |
| DE | 4440634 | | 7/1996 |
| EP | 1168888 | | 1/2002 |
| FR | 2570333 | | 3/1986 |
| GB | 820908 | | 9/1959 |
| GB | 917055 | A | 1/1963 |
| GB | 2106966 | | 4/1983 |
| GB | 2252285 | A | 5/1992 |
| GB | 2259287 | | 3/1993 |
| GB | 2261333 | | 5/1993 |
| GB | 2319943 | A | 6/1998 |
| JP | 405292638 | A | 11/1993 |
| JP | 407023520 | A | 1/1995 |
| JP | 2005180823 | | 7/2005 |
| JP | 2005180824 | | 7/2005 |
| RU | 2289892 | | 1/2006 |
| SU | 983433 | | 12/1982 |
| WO | WO 00/24634 | | 5/2000 |
| WO | WO 00/33614 | | 6/2000 |
| WO | WO 00/52966 | | 9/2000 |
| WO | WO 01/08973 | | 2/2001 |
| WO | WO 01/49564 | | 7/2001 |
| WO | WO 03/062056 | | 7/2003 |
| WO | WO 03/069955 | | 8/2003 |
| WO | WO 2005/061974 | A | 7/2005 |
| WO | WO 2006/002224 | | 1/2006 |
| WO | WO 2006/081180 | | 8/2006 |
| WO | 2007021270 | A2 | 2/2007 |

OTHER PUBLICATIONS

International Preliminary Report on Patentability issued in related PCT Patent Application PCT/US2009/063407, dated May 19, 2011, 7 pages.

Petrenko, V.F. "The effect of static electric fields on ice friction" J. Appl. Phys.76(2) Jul. 1994.

Petrenko, V.F. & Colbeck, S.C., "Generation of electric fields by ice and snow friction" J. Appl. Phys.77(9) May 1995, pp. 4518-4521.

"Everstart Automotive". May 5, 2003, 1 page.

Maxwell Technologies: Ultracapacitors-Booslcap PC 2500, May 1, 1995, 2 pages.

Petrenko, V.F. & Schulson, E.M. "Action of Electric Fields n the Plastic Deformation of Pure and Doped Ice Single Crystals" Philosophical Magazine A, 1993, vol. 76, No. 1, 173-185.

Reich "Interface Influences Upon Ice Adhesion to Airfoil Materials" BF Goodrich, Jan. 1994, 10 pages.

"Icing Wind Tunnel", Meeting the Challenges of Ice Testing in a World-Class Facility BF Goodrich, 1994, 3 pages.
Phillips "New Goodrich Wind Tunnel Tests Advanced Aircraft De-Icing Systems" 1988, 4 pages.
Petrenko "Electromechanical Phenomena in Ice" Feb. 1996, 42 pages.
Petrenko "The Surface of Ice, Ice/Solid and Ice/Liquid Interfaces with Scanning Force Microscopy" Oct. 1996, 6 pages.
Petrenko, V.F. & Peng, S."Reduction of Ice Adhesion to Metal by Using Self-Assembling Monolayers (SAM's)" Jan.-Feb. 2003 vol. 81, pp. 387-393.
Petrenko, V.F. & Schulson, E.M. "The effect of static electric fields on proton conductivity of single ice crystals" J. Appl. Phys. 76 (2) Jul. 15, 1994.
Courville, Z. & Petrenko, V.F. "De-icing Layers of Interdigitated Microelectrodes", 2000, Mat. Res. Soc. Symp. Proc. vol. 604, pp. 329-334.
Petrenko, V.F. & Qi, S. "Reduction of Ice Adhesion to Stainless Steel by Ice Electrolysis", vol. 86, No. 10, Nov. 1999, pp. 5450-5454.
Petrenko, V. F. & Whitworth, R.W. "Physics of Ice", 1998, 195 pages.
Petrenko,V.F, et al—"Pulse Electrothermal De-Icing", Proceedings of the International Offshore and Polar Engineering Conference, May 30, 2003; pp. 435-438.
Incropera, F.P. & DeWitt, D.P.; Fundamentals of Heat and Mass Transfer; 5th Ed.; John Wiley & Sons; 2002; pp. 596-601.

* cited by examiner

REFRIGERANT EVAPORATORS WITH PULSE-ELECTROTHERMAL DEFROSTING

RELATED APPLICATION

This application claims priority to U.S. Provisional Patent Application Ser. No. 61/111,581, filed Nov. 5, 2008, the disclosure of which is incorporated herein by reference.

FIELD

The present document relates to the field of refrigerant evaporators. In particular, the disclosed refrigerant evaporators are adapted for pulse electrothermal defrosting and have high refrigerant tube density permitting efficient heat exchange.

BACKGROUND

It is desirable to make refrigerant evaporators efficient, compact, and lightweight. When compact and lightweight evaporators are used with air containing moisture, however, the moisture tends to condense on the evaporator as a layer of ice or frost. Before long, the ice clogs the evaporator and system efficiency is impaired.

The narrower air passages are between cooling coils or fins of an evaporator, the more quickly these passages accumulate ice and become obstructed. When the air passages are obstructed, airflow through the evaporator is impeded and efficiency of the refrigeration system incorporating the evaporator is also impaired.

In our previously issued patents and applications, it has been shown that tubing of an evaporator may serve as an electrical resistive heater, and that electrical current through this resistive heater may serve to melt and remove ice from the tubing and fins of the evaporator. We have used the term Pulse ElectroThermal Defrosting (PETD) to describe application of electrical power in pulses, typically of under a minute duration, and of high power density often greater than two kilowatts per square meter, to defrost evaporators and other devices.

In our prior work, electrical resistive heaters formed directly from common refrigeration tubing materials such as aluminum and copper have had low resistance. Providing reasonable electrical power to such low resistance resistive heaters requires heavy and expensive high current wiring and step-down transformers. For example, we have a system where the tubing of the evaporator itself serves as a secondary of a step-down transformer that is inductively coupled to a primary connected to an alternating current supply.

It is desirable to increase the electrical resistance of an evaporator to permit use of lower currents and higher voltages for melting and removing ice from tubing of the evaporator. Higher resistance has advantage in that it permits use of lighter wiring and less expensive switching devices and/or transformers.

We have also previously disclosed evaporators having higher resistance thin film resistive coatings over nonconductive or electrically insulated tubing. These embodiments are somewhat expensive to build because deposition of such thin film coatings is expensive.

SUMMARY

A pulse electrothermal defrost evaporator system has multiple refrigerant tubes formed from an electrically and thermally conductive material and connected in parallel to reduce resistance to refrigerant flow. These tubes are, however, connected electrically in series to provide high electrical resistance. A controller is capable of detecting ice accumulation and connecting the series-connected tubes to a source of electrical power for deicing when it is necessary to deice the tubes.

In an alternative embodiment, a pulse electrothermal-defrost evaporator system has a long, wide-lumen, refrigerant tube to simultaneously provide moderately low resistance to refrigerant flow, and a moderately high electrical resistance. A controller is capable of detecting ice accumulation and connecting the series-connected tubes to a source of electrical power for deicing when it is necessary to deice the tubes.

DETAILED DESCRIPTION OF THE EMBODIMENTS

Figure 1:
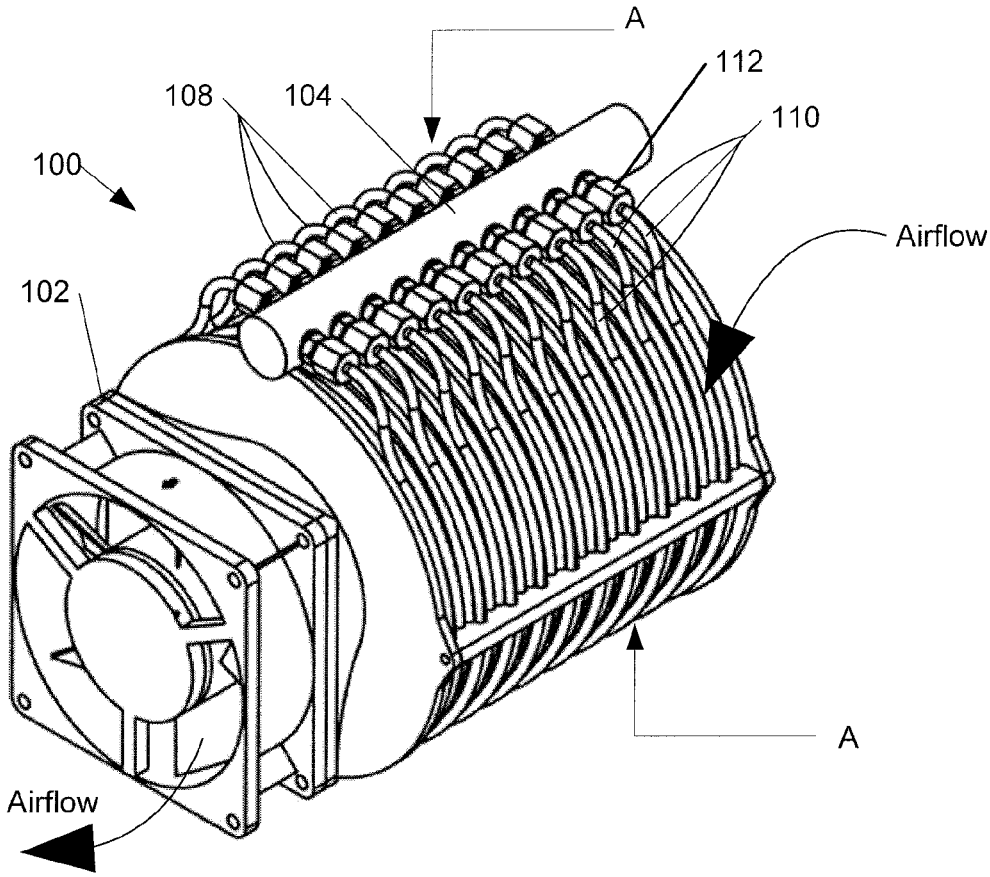
FIG. 1 is a perspective view of a refrigerant evaporator having refrigerant tubing in a spiral shape and an axial fan for forced-air circulation.
Figure 2:
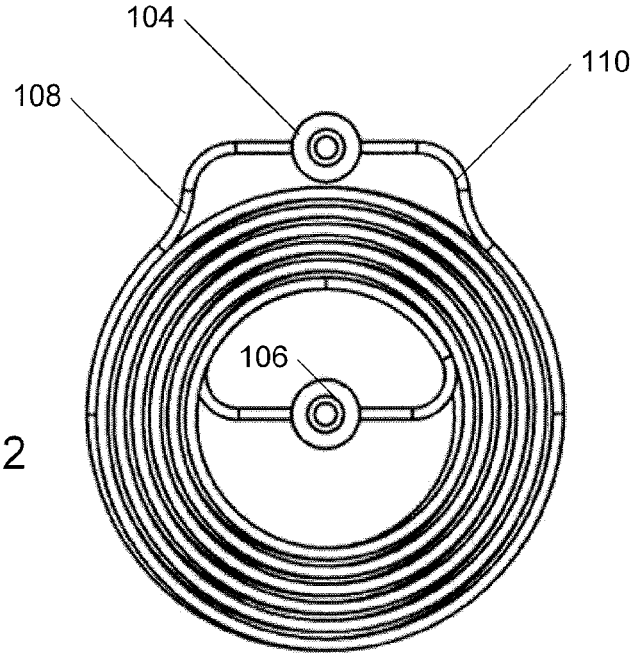
FIG. 2 is a cross section of the evaporator of FIG. 1 taken at points A-A in FIG. 1.
Figure 3:
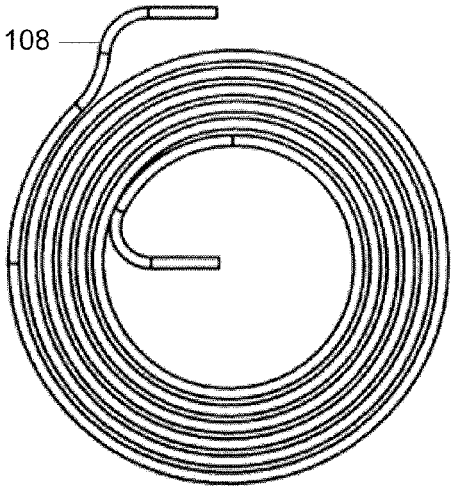
FIG. 3 illustrates an individual tube of the evaporator of FIG. 1.

FIG. 1 illustrates a refrigerant evaporator 100 with a fan 102 for circulating air through the evaporator where the air is cooled, and thence into a refrigerator, freezer, icemaker, walk-in freezer, or other device or area where cooled air is desired. A cross section of this embodiment appears in FIG. 2. The evaporator has a refrigerant input and distribution manifold 104 and a refrigerant collection and output manifold 106 (FIG. 2). The evaporator 100 has refrigerant tubes 108 connecting the distribution manifold 104 and the output manifold 106; these are wound in a spiral in a first direction. Additional refrigerant tubes 110, also connecting the distribution manifold 104 and the output manifold 106, these are wound in a spiral in a second direction. Winding of the tubes 108, 110 in both directions permits tubes to connect to manifolds 104, 106 alternately on opposite sides of the manifolds 104, 106, thereby providing ample room for fittings 112 used to attach the tubes 108, 110 to the manifolds 104, 106, and permitting access for use of wrenches to tighten these fittings.

In the embodiment of FIG. 1, the refrigerant tubes 108 are constructed from a metal that is an electrical conductor. In order to facilitate defrosting with electrical power, the tubes may be constructed of a metal, such as stainless steel or a nickel-chromium-iron alloy, having good corrosion resistance, low resistance to refrigerant flow, and higher resistance to electricity than that of pure aluminum or pure copper. Also, other electrically-conductive materials of moderately high resistivity can be used to fabricate the tubes. Examples of such moderately resistive materials include electrically-conductive polymers, zinc or tin-plated steel, titanium, and similar materials.

In some of the embodiments of FIGS. 1, 8, 10 and 12 the electric currents in the neighboring tubes may flow in the opposite directions, thus reducing the evaporator's total electrical inductance. Lower electrical inductance allows for higher power factor when tubes are heated with an AC power supply.

In the embodiment of FIG. 1, the refrigerant tubes 108 are connected in parallel for purposes of refrigerant flow. Collectively, these tubes therefore offer little resistance to the flow of refrigerant, with little pressure drop, and therefore require little power from the refrigeration pump be expended in moving refrigerant through them. Since there is little power lost in moving refrigerant through the evaporator, use of an evaporator resembling that of FIG. 1 may provide greater refrigeration power efficiency than with other designs.

The embodiment of FIG. 1 has low electrical inductance because half of the tubes carry current in each direction around the spiral; magnetic fields created by these currents tend to cancel, thereby reducing inductance of the evaporator.

In the embodiment of FIG. 1, air enters the evaporator through spaces between the refrigerant tubes 108, 110, and exits through the fan 102. In an alternative embodiment, airflow through the evaporator is reversed, entering through the fan and exiting through spaces between the refrigerant tubes 108, 110. In yet another embodiment, having a central plug and a peripheral shroud (not shown), air enters at an end of the spiral coils of the evaporator opposite the fan, and exits through the fan 102

In alternative embodiments, such as those having narrow welded, staked or pressed fittings in place of threaded fittings, the tubes 108, 110, may all be spirally wound in the same direction since these fittings 112 may be closely spaced without interfering with each other.

Figure 5:
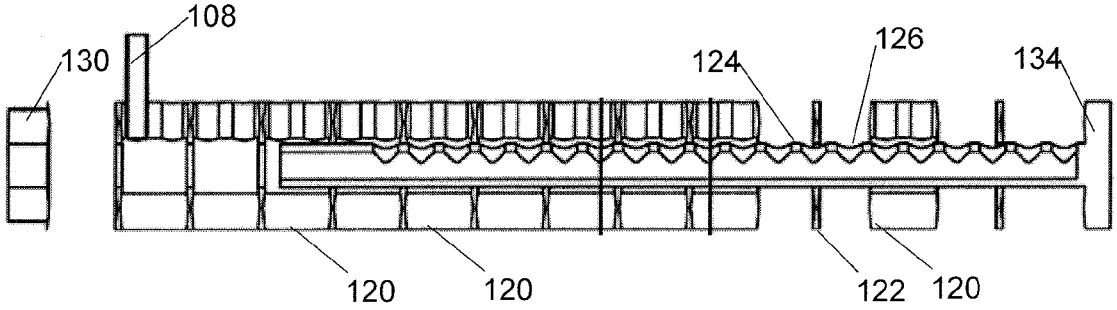
FIG. 5 is a partially exploded cross section of a manifold for the embodiment of FIG. 1.
Figure 4:
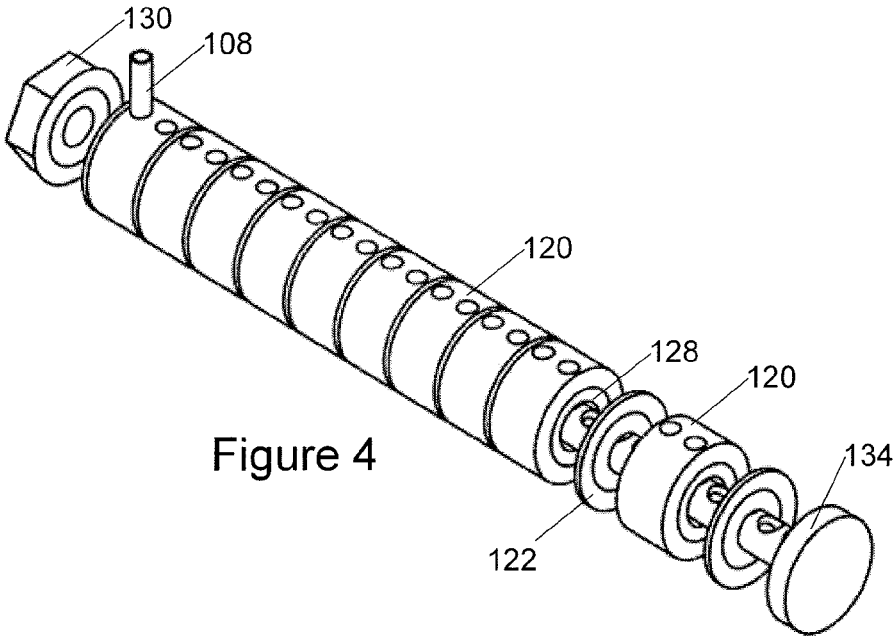
FIG. 4 is a partially exploded perspective view of an alternately conductive and insulating manifold for the embodiment of FIG. 1.

In an embodiment, each alternately conductive and insulating manifold 104, 106, as illustrated in FIG. 4 and FIG. 5, has an outer section fabricated from a series of conductive rings 120. These conductive rings 120 are made from metal and are separated by insulating rings 122 fabricated from a nonconductive material such as a plastic or a silicone elastomer. The alternating conducting rings 120 and insulating rings 122 form a linear array of alternating conductors and dielectric unions. In embodiments, insulating rings 122 are made from nylon, cross-linked polyethylene, ABS, polyimide, polyamide, or a composite made of one of those materials and epoxy resin with glass-fiber or carbon fiber reinforcement. In a particular embodiment, the conductive rings 120 and insulating 122 rings of manifold 104, 106, are assembled over a core tube 124. The core tube 124 has holes 126 allowing for passage of refrigerant from within core tube 124 into tubes, such as tube 108, of the evaporator. In an embodiment, core tube 124 is made of a nonconductive material, in an alternative embodiment core tube 124 is made of a conductive material, but conductive 120 rings are insulated from the core tube 124 by insulating inner rings 128. The manifold 104, 106 is held together by compression of the rings 120, 122 with an end nut 130 and a flange 134 secured over the core tube 124.

In this embodiment, with the exception of end rings of one or both manifolds, each conductive ring is electrically connected to two tubes 108, 110, and each pair of tubes is electrically insulated from each other pair of tubes.

Figure 6:
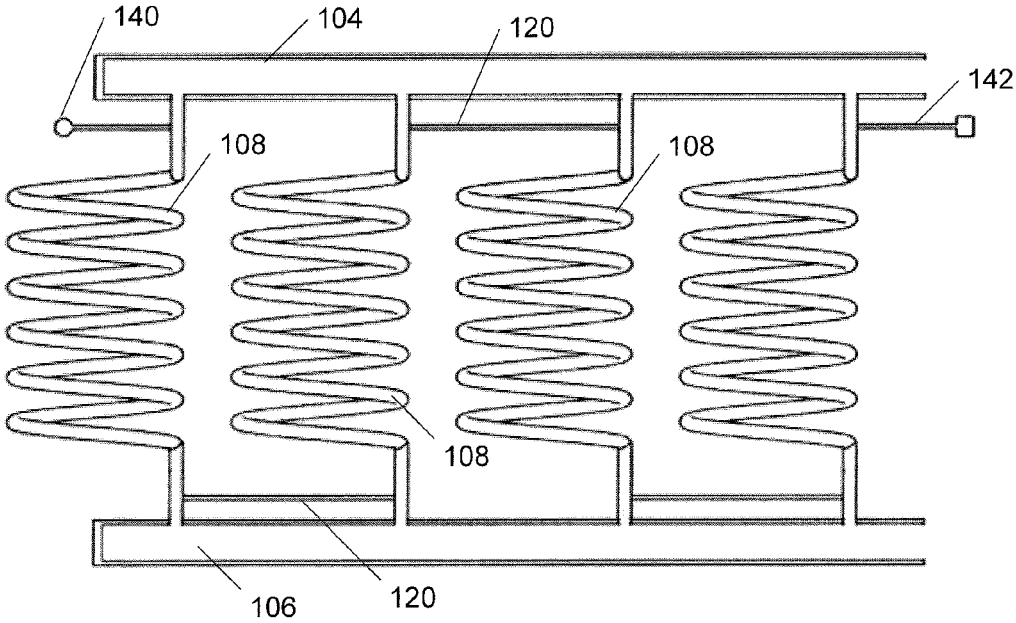
FIG. 6 is a schematic diagram illustrating electrical series connection of the tubes of the embodiment of FIG. 1 using the manifold of FIGS. 4 and 5.

In this embodiment, the conductive rings of the output manifold 106 are offset by one tube from the conductive rings of the input distribution manifold 104. A single-tube ring is provided in place of two-tube rings at one or both ends of at least one of the manifolds 104, 106, to allow for this offset, these are arranged such that one single-tube ring appears at each end of the evaporator. This results in the spiral tubes 108 being electrically connected in series from a first electrical connection 140 to a second electrical connection 142 as illustrated in FIG. 6, where the conductive rings 120 electrically connect adjacent tubes 108. An electrical connection for application of a heating current is provided at the single-tube ring, or attached to the tube adjacent to the single-tube ring.

Figure 7:
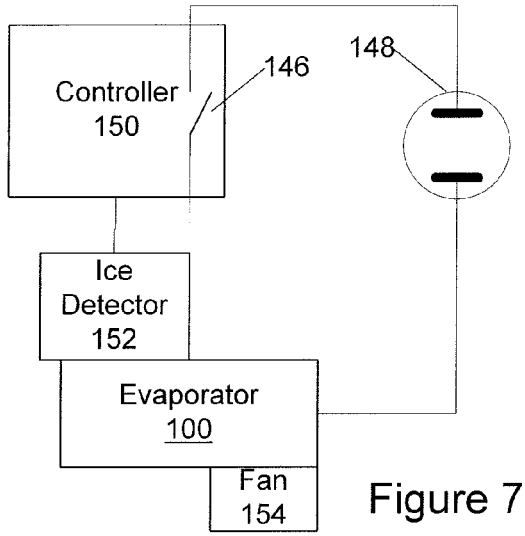
FIG. 7 is an electrical schematic diagram illustrating connection of the evaporator to a power source through a controller.

In an embodiment, the resistive heater formed of the series-connected spiral tubes 108, 110, of the evaporator 100 is connected through a switching device 146 to a 115-volt or a 220-volt power-line source 148, as illustrated in FIG. 7. When defrosting of the evaporator 100 is required, the switching device 146, a component of a controller such as controller 150, closes to couple the power-line source 148 to the evaporator 100.

In an alternative embodiment, manifolds 104, 106 are fabricated from a nonconductive material such as a plastic; in this embodiment conductive metal straps are secured near the ends of, and bridging between in pairs, the refrigerant tubes 108, 110 to provide electrical connectivity equivalent to that of FIG. 6.

In the embodiments of FIGS. 1 through 6, the manifolds 104, 106 provide for parallel flow of refrigerant through the tubes 108, 110.

A spiral-coil evaporator similar to one shown in FIG. 1 was designed, manufactured and tested. The evaporator was built of stainless-steel (SS) tubes having an outer diameter of 3.175 mm and wall thickness of 0.254 mm and total length of 38 meters. The evaporator has twenty spiral coils with six turns of tubes per coil. Tubes pitch in the axial direction is six mm and in the radial direction is five mm. The small tube diameter and small space between the tubes of about two millimeters provides a high rate of heat-exchange between the tubes and air and, thus, allows a small and light evaporator. Electrically, all the spirals are connected in series, providing electrical resistance of about ten ohms.

While the evaporator embodiment built and tested used refrigerant tubes having a single refrigerant passage of round cross section, similar devices may be built of tubing having other cross sections. For example, an alternative embodiment may be built of tubing having a square or rectangular cross section and formed into a spiral similar to that illustrated in FIGS. 1 through 6. An additional embodiment is formed using microchannel refrigerant tubing having several parallel lumens, the microchannel tubing having an overall rectangular shape.

The evaporator cooling capacity at temperature difference between inlet air and tubes, TD=6° C., was found as $P_C$=200 W. It has been found that sufficiently electrically resistive evaporators can also be directly connected to a common AC line, such as 115 VAC/60 Hz, thus avoiding cost of a step-down transformer. To perform PETD-enabled defrost, the evaporator was connected through a switch 146 (FIG. 7) of a controller 150 directly to a 115 VAC/60 Hz power supply 148 without an intervening transformer, whereupon it draws approximately eleven and a half amperes, for a power dissipation of about one thousand three hundred watts. The test showed that it took only about thirty seconds to remove half-millimeter-thick frost from the evaporator. The defrost time is about forty to sixty times shorter than a typical length of defrost cycle used for conventional fins-on-tube residential evaporators of the same cooling capacity. That prototype evaporator had also about one tenth the volume of conventional evaporators of the same cooling capacity, thereby providing more useful space inside a freezer compartment.

In an embodiment, controller 150 is capable of detecting ice and/or frost accumulation on the evaporator. In various embodiments, the controller does so by detecting airflow obstruction through the evaporator, by detecting changes in response of the evaporator to vibration, or by detecting obstruction of light beams passing through the evaporator at locations where ice or frost will obstruct the light beams.

Figure 8:
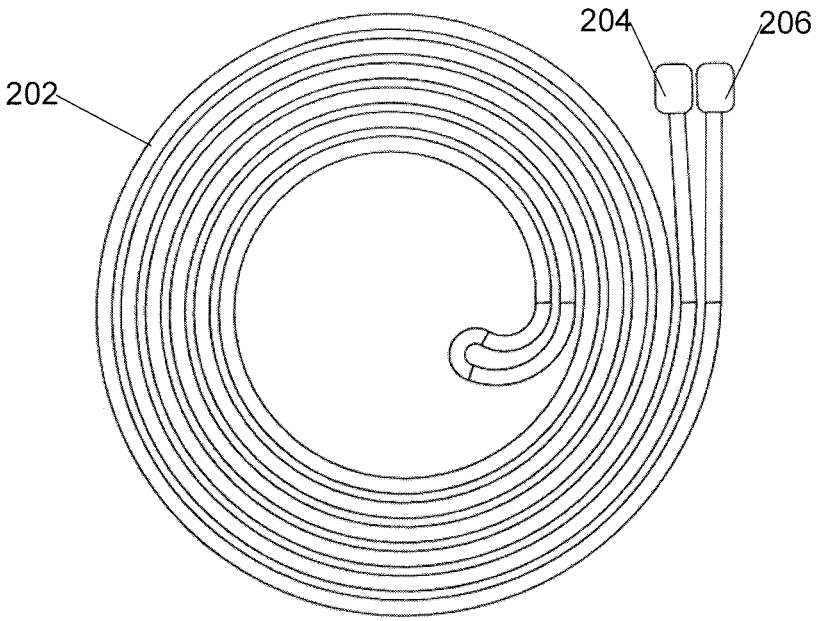
FIG. 8 is a view of a folded-spiral tube for use in an evaporator.
Figure 9:
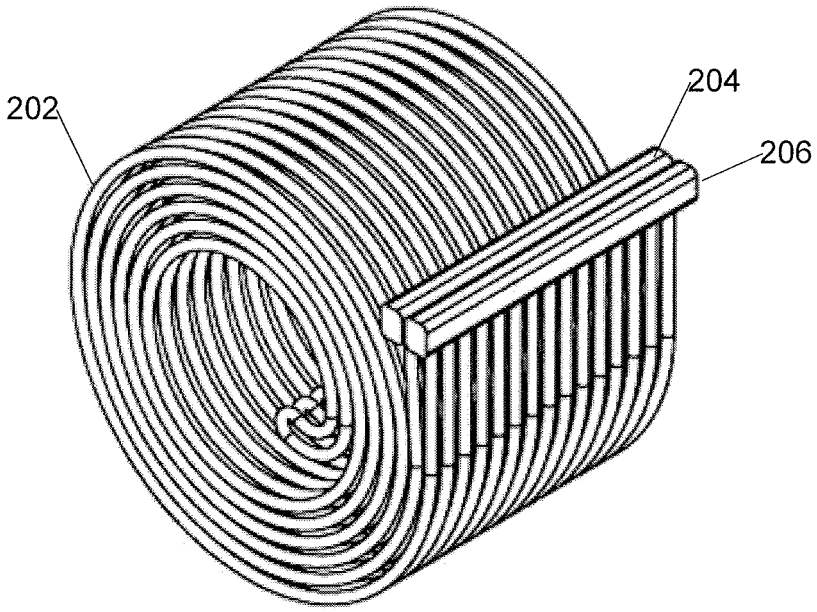
FIG. 9 is a perspective view of an evaporator using the tube of FIG. 8.

In an alternative embodiment, a refrigerant tube 202 is folded, then wound into a folded spiral as illustrated in FIGS. 8 and 9. This folded-spiral tube 202 is coupled to an input manifold 204 and to an output manifold 206. The evaporator of FIG. 9 may be coupled to a fan for drawing air through the spaces between tubes of the evaporator and circulating cooled air similarly to the evaporator of FIG. 1. The embodiment of FIG. 9 has advantage in that, because half of each tube carries current in each directions around the spiral, magnetic fields created by these currents tend to cancel, thereby reducing inductance of the evaporator.

Figure 10:
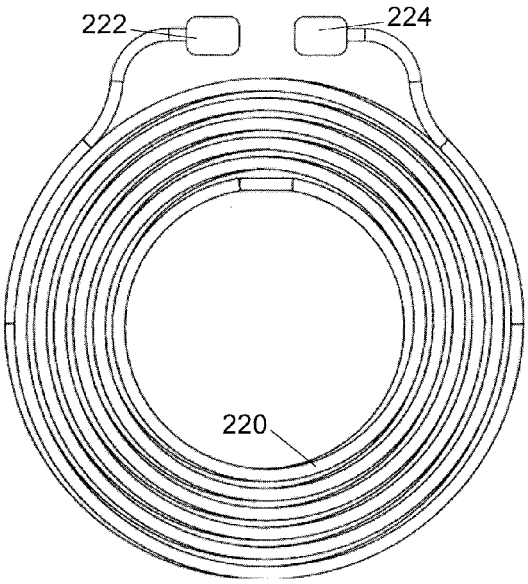
FIG. 10 is a view of a double-spiral tube for use in an evaporator.

In an embodiment, FIG. 10, having both manifolds external to the coil like that of FIG. 9, a tube 220 exits from an input manifold 222 and spirals towards the center, it is then offset perpendicular to the plane of FIG. 9 by a tube-to-tube spacing, whereupon it spirals outwards to enter the output manifold 224. As with the manifolds 104, 106 of FIGS. 1 and 4, multiple tubes are in parallel for the passage of refrigerant but are effectively connected electrically in series. The embodiment of FIG. 10 has advantage in that, because half of each tube carries current in each direction, magnetic fields created by these currents tend to cancel, thereby reducing inductance of the evaporator.

Figure 11:
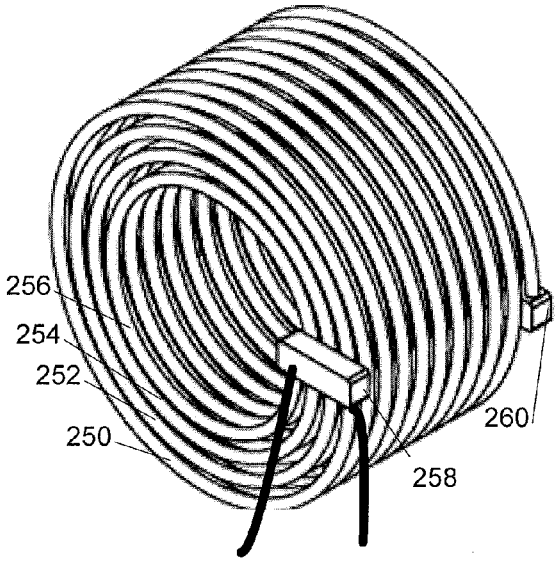
FIG. 11 is a view of an evaporator having multiple concentric cylindrical-wound evaporator tubes in parallel for refrigerant and coupled electrically in series.

In yet another embodiment, as illustrated in FIG. 11, an evaporator has multiple concentric cylindrical-wound evaporator tubes 250, 252, 254, 256 coupled in parallel for refrigerant and coupled electrically in series through use of alternately conductive and insulating manifolds 258, 260 similar to those described with reference to FIGS. 4 and 5. Since the direction of current in each tube is opposite that of the tube of the next smaller cylinder, the magnetic fields generated by these currents largely cancel, thereby reducing inductance of the evaporator.

Figure 12:
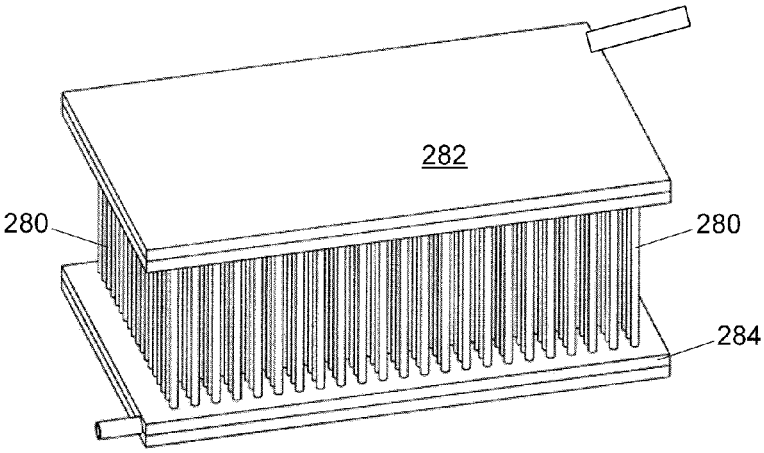
FIG. 12 is a view of an evaporator having straight tubes and flat platelike manifolds, the manifolds have conductive-by-pair and insulated-between-pair construction similar to those of FIGS. 4 and 5.

In yet another embodiment, as illustrated in FIG. 12, an evaporator has multiple straight evaporator tubes 280 coupled in parallel for refrigerant and coupled electrically in series through use of planar input and output manifolds 282, 284. The input and output manifolds 282, 284 have a rectilinear array of conductive elements for electrically coupling evaporator tubes 280 in pairs, and insulating elements for separating conductive elements. The manifolds 282, 284 therefore present a rectangular array of conductive elements and dielectric unions, functionally similar to the linear array of conductive elements and dielectric unions described with reference to FIGS. 4 and 5.

Figure 13:
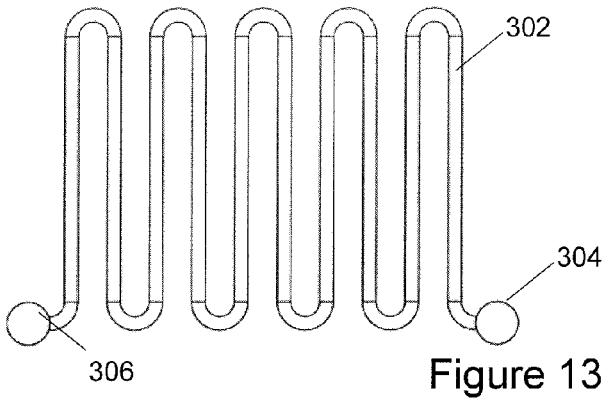
FIG. 13 is a view of a serpentine tube for use in an evaporator.
Figure 14:
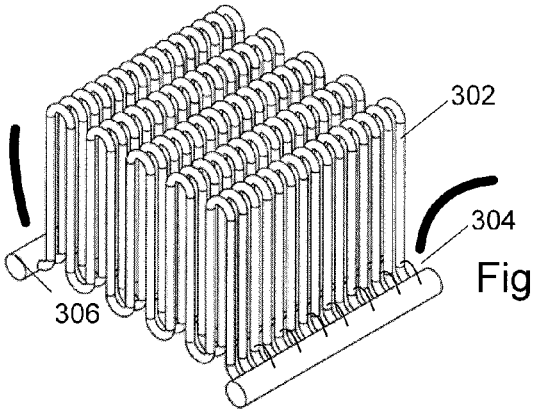
FIG. 14 is a perspective view of an evaporator using the tube of FIG. 13 with manifolds like those of FIGS. 4 and 5.

In yet another embodiment, as illustrated in FIG. 13, a serpentine refrigerant tube 302 tube for use in an evaporator extends from an input manifold 304 and an output manifold 306. FIG. 14 is a perspective view of an evaporator using the tube of FIG. 13 and having manifolds like those of FIGS. 4 and 5. As with the embodiment of FIG. 1, the evaporator tubes 302 are coupled in parallel for refrigerant and coupled electrically in series through the alternately conductive and insulating input and output manifolds 304, 306.

In these embodiments, including those of FIGS. 1, 9, 11, 12, and 14, a first and a second electrical connection are made to the series-connected evaporator refrigerant tubes. With reference to FIG. 7, these electrical connections are coupled through a switching element 146, such as a triac, a relay, or other semiconductor switch, in a controller to a source of electrical power 148, with may be a commercial power main. The controller 150 uses an ice detector 152 sensor, such as an airflow sensor, to detect the presence of ice within the evaporator 100. When ice is detected, the controller closes switching element 146 to apply a high-power pulse of electrical power from the power source 148 through the electrical connections to the series-connected evaporator tubes.

By applying pulses of high power to the evaporator refrigerant tube, the controller can deice the evaporator in less than about a minute, and in embodiments between fifteen and thirty seconds. This rapid defrosting permits high efficiency of the system by reducing stray heating of the refrigeration system and permitting high duty cycles of the refrigeration system.

Figure 15:
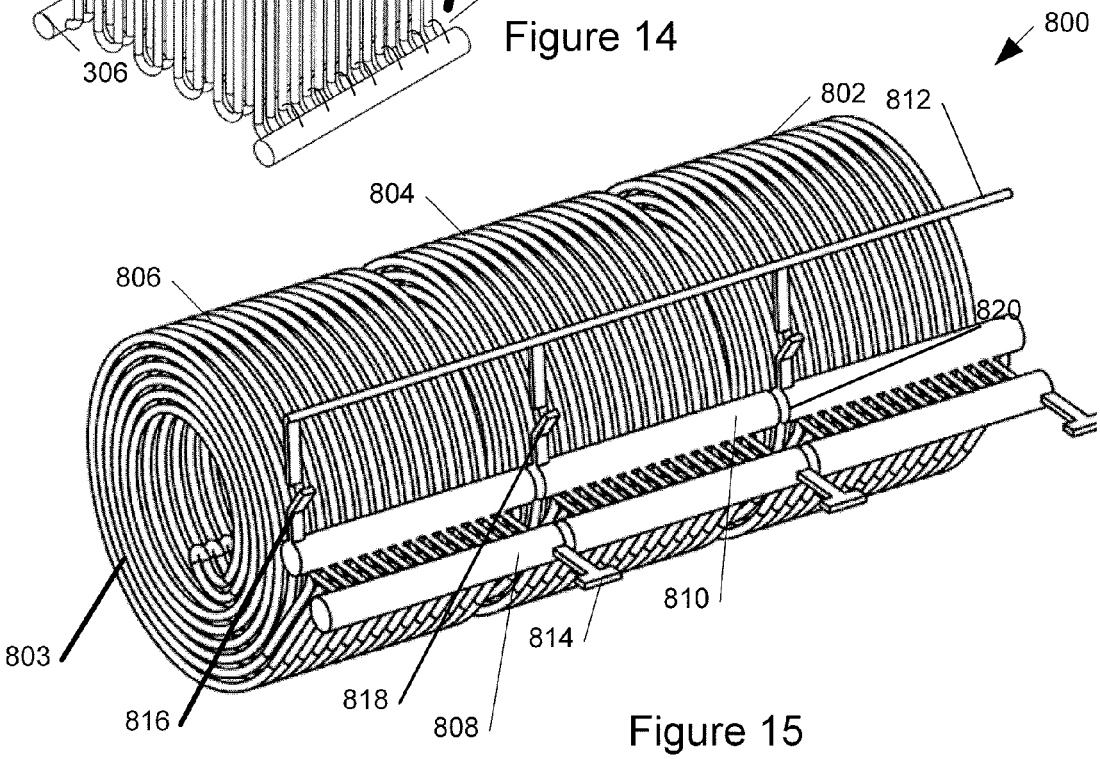
FIG. 15 is a perspective view of an evaporator having three sections each resembling that of FIG. 1.

As illustrated in FIG. 15, an evaporator system 800 may have multiple sections, each of which is as previously described with respect to the embodiments of 1, 9, 11, 12, and 14. In an example embodiment, evaporator system 800 has three sections, 802, 804, 806, each of which has refrigerant tubes 803 coupled in parallel for refrigerant flow but in series for electric current between an input manifold 808 and an output manifold 810. In the example of FIG. 15, each refrigerant tube is wound in a double-spiral as with the embodiment of FIG. 9.

The pulse-electrothermal deicing of the evaporator 800 is powered by two busses, one of which 814 may be coupled to an AC neutral connection, and the other 812 to a power source, such as an AC mains connection, an AC-DC, DC-DC, or DC-AC voltage converter, a pulse-duty transformer, a battery, or a supercapacitor, each section 802, 804, 806 having an electronic or electromechanical switching device 816, 818, 820 of the controller 150 for coupling that section 802, 804, 806 to the power source. In an embodiment, the controller 150 ensures that only one section 802, 804, 806 of the evaporator is coupled to the power source at a time to ensure that the power source is not overloaded.

In an alternative embodiment, suitable for use with high capacity systems the three sections 802, 804, 806 are coupled through switching devices 816, 818, 820 in Y or Delta connection to the three phases of a three-phase alternating-current source such as a three-phase mains power system of two hundred eight to six hundred forty volts, without any intervening stepdown transformer.

Evaporators of the present design have tubes that may be connected to sources of electrical power at times; as with anything else made by man they may also require maintenance from time to time. While not explicitly shown in most of the drawings, it is understood that safety interlocks will be employed to disconnect the evaporator from the power source during maintenance.

The illustrated embodiments show use of dielectrically isolated manifolds, such as those of FIGS. 4 and 5, with conductive tubes and conductive rings in the manifolds to connect evaporator tubes in parallel for refrigerant flow, and in series for electrical current flow. An embodiment may incorporate multiple evaporator sections, where each section resembles that of 1, 9, 11, 12, or 14, where the sections are coupled together in other combinations than those previously discussed. For example, a heavy duty evaporator may have eight sections, coupled in a series-parallel configuration, as illustrated in FIG. 16, together with other components of a refrigeration system.

Figure 16:
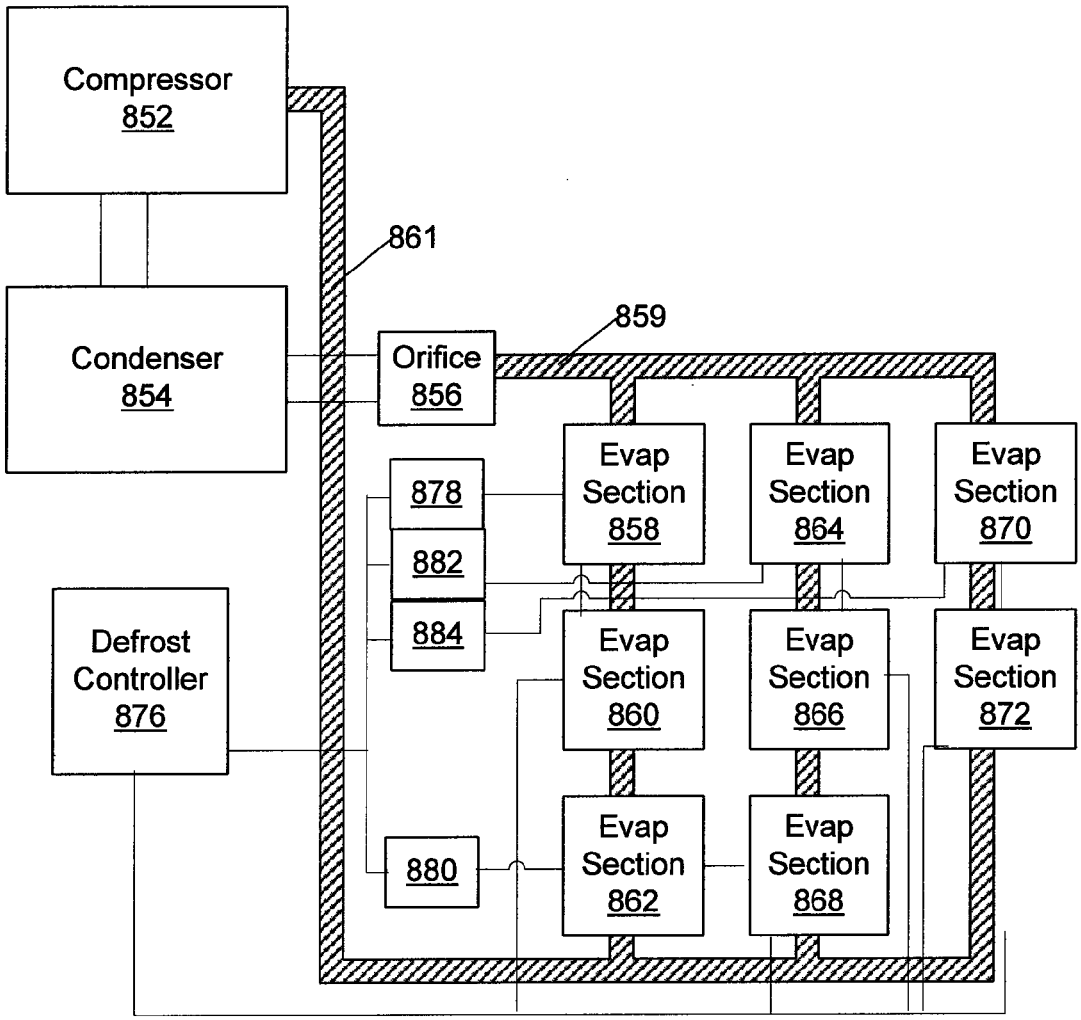
FIG. 16 is a schematic view of a refrigeration system having multiple evaporator sections coupled together in series-parallel, with the electrical connections differing from the refrigerant flow connections.

In the system of FIG. 16, there is a compressor 852 and condenser 854 as known in the art of refrigeration. Compressed refrigerant expands after passing through an orifice or expansion valve 856, and through an input or distribution manifold 859, before flowing into the evaporators. Refrigerant flows through evaporator sections 858, 860, and 862 in series. Refrigerant also follows through sections 864, 866, 868 in series, and through 870 and 872 in series. To prevent evaporator sections 870, 872 from hogging refrigerant, these evaporators may be made of smaller diameter tubing than the other sections of the evaporator. Refrigerant is collected by an output manifold 861 from the evaporator sections for return to the compressor.

The multiple sections of FIG. 16 are coupled together in pairs in series electrically, and may have electrical connections differing from the refrigerant flow connections. For example, switching device 878 connects sections 858 and 860 in series to a source of electrical power when defrost controller 876 determines that defrosting is required. Similarly, switching device 880 connects sections 862 and 868 in series to a source of electrical power when defrost controller 876 determines that defrosting is required. Further, switching device 882 connects sections 864 and 866 in series to a source of electrical power when defrost controller 876 determines that defrosting is required. Finally, switching device 884 connects sections 870 and 872 in series to a source of electrical power when defrost controller 876 determines that defrosting is necessary. The source of electrical power is typically directly coupled to an AC mains connector without need for any intervening stepdown transformer.

Figure 17:
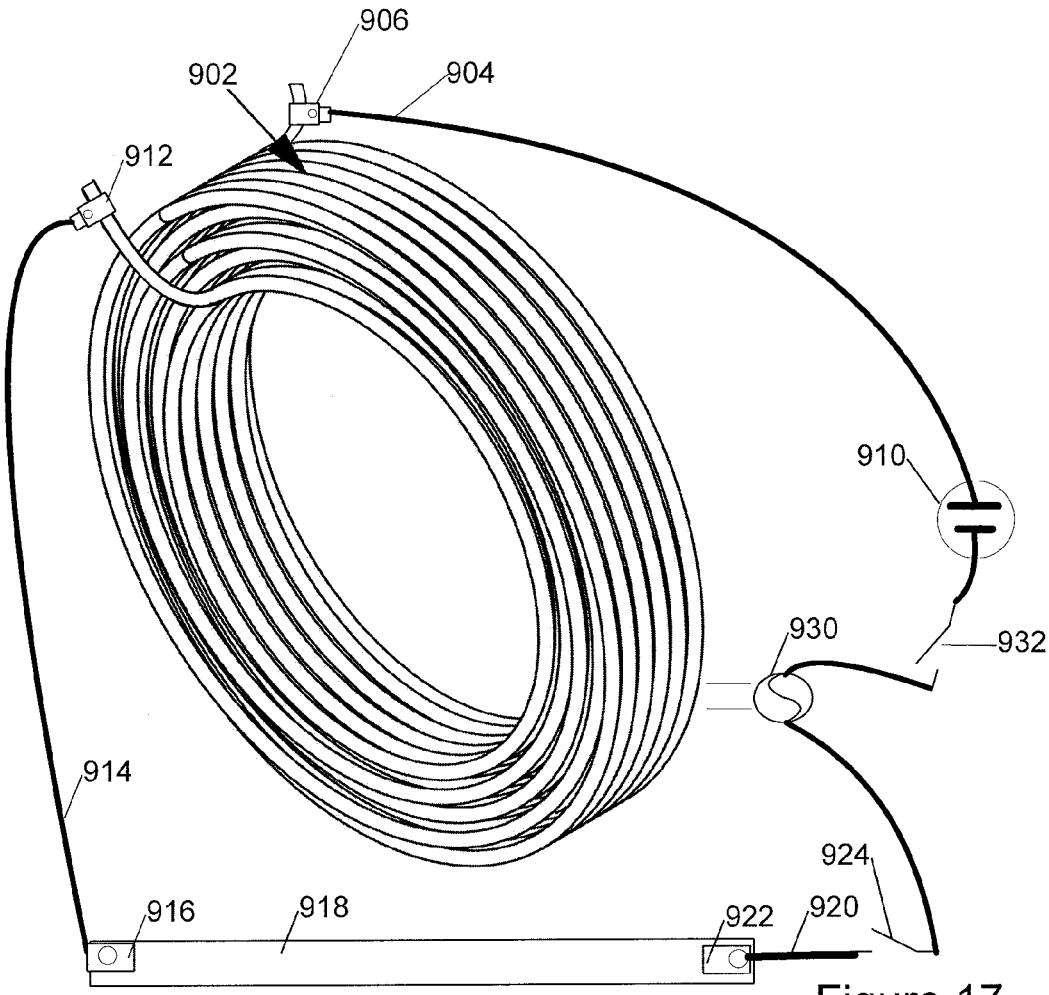
FIG. 17 is an illustration of an evaporator having a single, long, coiled, refrigerant tube.

The embodiment of FIG. 17 has an evaporator having a refrigerant tube 902 of length at least twenty meters, and in an embodiment twenty-six meters with diameter of 6.35 mm (one quarter inch) and with wall thickness of 0.127 mm. It is preferred that the tube 902 have resistance of at least five ohms to permit operation without a transformer. This tube is wound as five layers of six turns each into a circular evaporator having resistance of approximately seven ohms. A clamp 906 attaches a wire 904 to the tube 902 at a first end, the wire 904 is coupled to a neutral connection of an AC-mains supply connector 910, the AC-mains supply connector is typically adapted for direct connection, without any stepdown transformer required, to an alternating current supply of from one hundred ten to two hundred forty volts, the voltage depending upon power distribution systems commonly used in the country in which the device is intended to operate. Another clamp 912 couples a second wire 914 to a second end of tube 902, the second wire connects to a current-spreading clamp 916 attached to an end of a stainless-steel evaporator pan 918 for collecting water and ice released from the evaporator tube 902 during deice cycles and for evaporating that water. In an embodiment, the pan has resistance of about one half ohm. A third wire 920 is attached to another end of the evaporator pan 918 by another current-spreading clamp 922, the third wire connects to a pole of a switching device 924 of a controller for controlling a deice cycle. A second pole of the switching device 924 is coupled to the AC supply connector. The series combination of tube 902 and pan 918 is approximately seven and a half ohms, and will draw approximately 15 amperes from a 115-volt power supply for a total power dissipation about 1750 watts, for a deicing power density of roughly three kilowatts per square meter of heat-exchanger tubing 902. As previously described, other embodiments may use other durations of short, high intensity, current pulses while providing power density of greater than one kilowatt per square meter of heat-exchanger surface area to permit rapid deicing when defrost is required. This evaporator has been found operable as a single evaporator tube for exchanging approximately two hundred watts between refrigerant and air in a freezer with refrigerant at minus twenty-five Celsius. In alternative embodiments, evaporator pan 918 may have a higher-resistance heating element coupled in parallel with the evaporator tubing 902 instead of the low-resistance series coupling illustrated.

The evaporator may be equipped, in preferably all non-neutral power connections, with a fusible-link or other thermal-cutoff safety device for disconnecting the deicing electric current should the switching device 924 of the controller fail in an ON condition and the evaporator overheat in consequence. Fusible-link 930 is therefore thermally coupled to the evaporator tubing 902 and is wired electrically in series with the evaporator tubing 902 and switching device 924.

Further, since direct contact of an electrically-energized evaporator with human skin may cause thermal or electrical burns, or even electrocution, it is desirable that the deicing current not be applied to the evaporator when accessed for repair or maintenance even if a user ignores directions and fails to disconnect power to the equipment of which the evaporator is a part. The evaporator is therefore equipped in all non-neutral power connections, and preferably in all power connections, with safety interlock devices such as interlock switch 932. Interlock switch 932 may be a plug and socket arrangement that requires disconnection of the plug from the socket in order to open a cabinet or housing within which the evaporator resides. Interlock switch 932 may also be one or more series-connected switching devices that are mechanically coupled to one or more components of a housing or cabinet within which the evaporator resides in such manner that opening the housing or cabinet opens switch 932.

While the thermal cutoff or fusible link 930 and safety interlock 932 are not separately illustrated in most figures for simplicity, it is understood that these devices are appropriate for use with all illustrated embodiments, and that these devices should be interpreted as components of all illustrated embodiments.

In order to prevent wasting power by electrically heating other components of the system in which the evaporator is used, the tube 902 is coupled through an insulating union to other refrigerant-containing components standard in a refrigeration system, such as a compressor, such as compressor 852 (FIG. 16), an orifice 856, and condenser 854.

Figure 18:
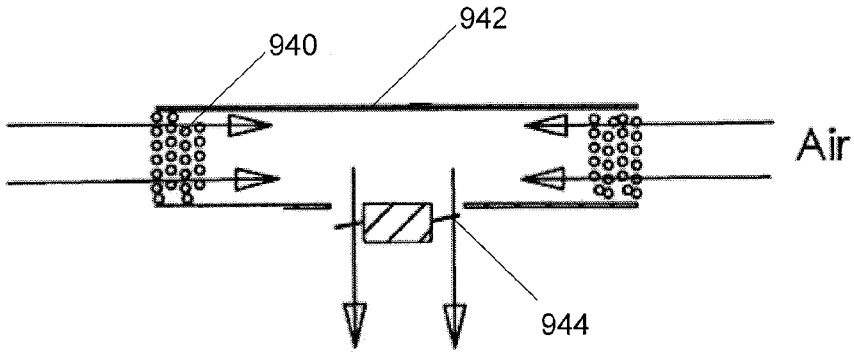
FIG. 18 is an illustration of an evaporator of FIG. 17 in a system.

An evaporator resembling that of FIG. 17 may be used as an evaporator 940 in a housing 942 and equipped with a fan 944 for drawing air through the evaporator and expelling chilled air into a freezer, as shown in FIG. 18.

The illustrated embodiments are tubes-only evaporators in that the heat exchange surface area is primarily a surface of refrigerant tubes, and not that of fins attached to the refrigerant tubes. Similar embodiments may have metallic heat-exchange fins attached to individual tubes of the evaporator such that these fins are in thermal contact with at least one tube of the evaporator, but are in electrical contact with no more than one tube of the evaporator because electrical contact of fins with multiple tubes may disrupt defrosting current through the evaporator. Such a serpentine-finned embodiment 960 is illustrated in FIG. 19.

In the serpentine-finned embodiment, a refrigerant tube 962 is formed of an electrically conductive material having some electrical resistance, such as a stainless-steel alloy. A sheet or strip of a alloy having resistivity within an order of magnitude of that of the tube 962 is punched with holes of sufficient diameter to pass tube 962 through the sheet and formed into a zig-zag or serpentine shape such that the holes align. The tube is then passed through the holes in the sheet, and electrically and thermally attached to the sheet at multiple points to form serpentine fins 964 attached to tube 962. At each end of tube 962 in an evaporator is a clamp 966, 972 for coupling tube 962 to wire 968 or other nearby or adjacent tubes (not shown). Tube 962 may be bent as illustrated in FIG. 20 or coiled (not shown) with overlying serpentine fins 964 either severed or continuous at the bends 970.

Figure 19:
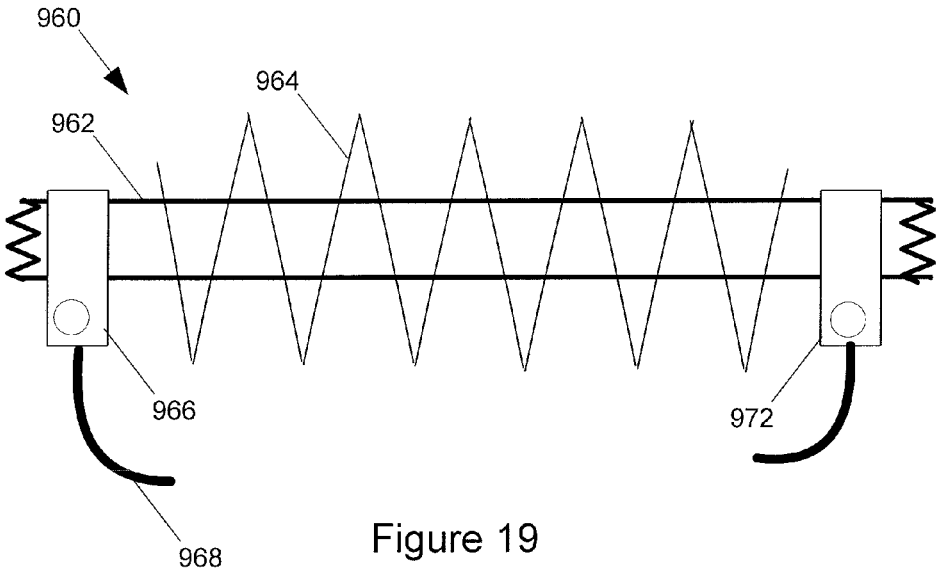
FIG. 19 illustrates an evaporator having a serpentine conductive fin attached to a conductive tube.
Figure 20:
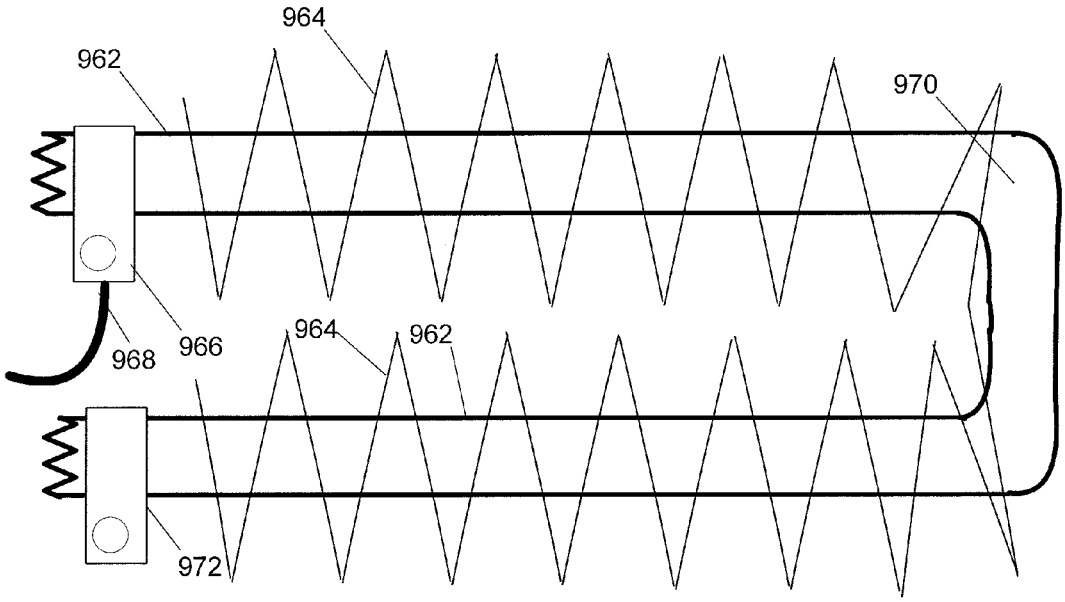
FIG. 20 illustrates an evaporator having serpentine conductive fins similar to that of FIG. 19 and having bends in the tube.

The embodiments of FIGS. 19 and 20 are particularly suited for use with airflow passing perpendicular to the page of the illustration, such that air passes on both surfaces of the fins 964, including through space between fins and tube 962, and across the exterior of the tube. In this embodiment, a portion of current flowing from clamp 966 through tube 962 to clamp 972 is diverted through fins 964, such that the fins 964 are heated both by thermal conduction from tube 962 and by electrical resistive heating in fins 964 during ice release. As previously described, short, high intensity, current pulses providing power density of greater than one kilowatt per square meter of heat-exchanger surface area are used to permit rapid deicing when defrost is required.

While the invention has been particularly shown and described with reference to a preferred embodiment thereof, it will be understood by those skilled in the art that various other changes in the form and details may be made without departing from the spirit and scope of the invention. It is to be understood that various changes may be made in adapting the invention to different embodiments without departing from the broader inventive concepts disclosed herein and comprehended by the claims that follow.

What is claimed is:

1. A pulse electrothermal defrost evaporator system comprising:

a plurality of refrigerant tubes (108, 202, 803) formed from an electrically conductive metal;

a first manifold (104, 204) for distributing refrigerant into the plurality of refrigerant tubes (108, 202, 803), the plurality of refrigerant tubes connected in parallel for refrigerant flow;

a second manifold (106, 206) for receiving refrigerant from the plurality of refrigerant tubes; and a controller (150) for detecting ice accumulation on the refrigerant tubes and for electrically connecting the refrigerant tubes to a source of electrical power to deice the refrigerant tubes when ice is detected on the refrigerant tubes;

wherein a plurality of the refrigerant tubes are electrically coupled together in series.

2. The evaporator of claim 1, wherein the evaporator has no heat interchange fins attached to tubes of the evaporator (FIG. 1).

3. The evaporator of claim 1 wherein the refrigerant tubes are formed from stainless steel.

4. The evaporator of claim 1 wherein an electric current in neighboring tubes flows in opposite directions to reduce the evaporator inductance (FIG. 8, FIG. 9).

5. The evaporator of claim 1 wherein adjacent tubes of the evaporator are wound in opposite directions to reduce the evaporator inductance.

6. The evaporator of claim 1 wherein a plurality of the refrigerant tubes are shaped into a shape selected from the group consisting of a spiral coil, a helical coil, a folded spiral, and a double spiral.

7. The evaporator of claim 1 wherein the evaporator is divided into a plurality of sections each comprising a plurality of refrigerant tubes coupled electrically in series, and wherein the controller is adapted for coupling sections of the evaporator to the source of electrical power individually.

8. The evaporator of claim 1 (FIG. 15) wherein the evaporator is divided into a plurality of sections (802, 804, 806) each comprising a plurality of refrigerant tubes coupled electrically in series, and wherein the controller (150) is adapted for coupling the plurality of sections together in a configuration selected from the group consisting of Y and Delta connections, and wherein the source of electrical power is a three-phase alternating current source.

9. The evaporator of claim 1 wherein the source of electrical power is selected from the group consisting of a battery, a DC-AC converter, and an alternating current mains power connection.

10. The evaporator of claim 1 wherein the first manifold (104, 204) further comprises a plurality of electrically conductive sections, where at least one electrically conductive section is separated from another electrically conductive section by a dielectric, and wherein at least one electrically conductive section of the manifold is electrically coupled to at least two tubes.

11. The evaporator of claim 1, further comprising a thermal cutoff, the thermal cutoff coupled thermally to, and electrically in series with, the refrigerant tubes to disconnect the refrigerant tubes from the source of electrical power on overheating of the refrigerant tubes.

12. The evaporator of claim 11, further comprising an interlock device, the interlock device coupled to disconnect the refrigerant tubes from the source of electrical power on opening of a housing, the refrigerant tubes being disposed within the housing.

13. A pulse electrothermal defrost evaporator system comprising:

a plurality of sections (802, 804, 806, 858, 860), each section comprising:

a plurality of refrigerant tubes (803) formed from an electrically conductive metal, a first manifold (808, 859) for distributing refrigerant into the plurality of refrigerant tubes, the plurality of refrigerant tubes connected in parallel for refrigerant flow, a second manifold (810, 861) for receiving refrigerant from the plurality of refrigerant tubes, and a first and a second electrical connection (812, 814) for coupling electrical power to the plurality of refrigerant tubes, the refrigerant tubes of each section being coupled together electrically in series;

a controller (876) for detecting ice accumulation on the refrigerant tubes and for electrically coupling the first electrical connection of at least one section to a source of electrical power to deice the refrigerant tubes when ice is detected on the refrigerant tubes of that section;

wherein the sections are coupled together for refrigerant flow in a pattern selected from the group consisting of series, parallel and series-parallel;

and wherein the sections (FIG. 16) are coupled together electrically in a pattern selected from the group consisting of series, parallel, and series-parallel.

14. The evaporator of claim 13 wherein the sections are coupled together for refrigerant flow in a pattern different from the pattern in which they are coupled together electrically.

* * * * *